US011335483B2

(12) United States Patent
Tsubokura et al.

(10) Patent No.: US 11,335,483 B2
(45) Date of Patent: May 17, 2022

(54) MAGNET STRUCTURE

(71) Applicant: TDK Corporation, Tokyo (JP)

(72) Inventors: Taeko Tsubokura, Tokyo (JP); Takeshi Masuda, Tokyo (JP); Toshihiro Kuroshima, Tokyo (JP)

(73) Assignee: TDK Corporation, Tokyo (JP)

( * ) Notice: Subject to any disclaimer, the term of this patent is extended or adjusted under 35 U.S.C. 154(b) by 363 days.

(21) Appl. No.: 16/159,764

(22) Filed: Oct. 15, 2018

(65) Prior Publication Data

US 2019/0115125 A1 Apr. 18, 2019

(30) Foreign Application Priority Data

Oct. 18, 2017 (JP) ..... JP2017-201725

(51) Int. Cl.
*H01F 1/057* (2006.01)
*C22C 28/00* (2006.01)

(52) U.S. Cl.
CPC ..... *H01F 1/057* (2013.01); *C22C 28/00* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 2012/0139388 | A1 | 6/2012 | Iwasaki et al. | |
| 2012/0280775 | A1* | 11/2012 | Nagata | C22C 38/005 335/302 |
| 2016/0297028 | A1 | 10/2016 | Sagawa et al. | |
| 2017/0103836 | A1* | 4/2017 | Hidaka | C22C 38/06 |
| 2017/0263380 | A1* | 9/2017 | Mino | H01F 41/02 |

FOREIGN PATENT DOCUMENTS

| | | | | |
|---|---|---|---|---|
| CN | 105051844 | A | 11/2015 | |
| CN | 105185500 | A | 12/2015 | |
| GB | 2497573 | A * | 6/2013 | H01F 41/0293 |
| JP | 2007-258455 | A | 10/2007 | |
| WO | WO 011/108704 | A1 | 9/2011 | |
| WO | WO-2014/148355 | A1 | 9/2014 | |
| WO | WO 2017/018252 | A1 | 2/2017 | |

* cited by examiner

*Primary Examiner* — Xiaowei Su
(74) *Attorney, Agent, or Firm* — Faegre Drinker Biddle & Reath LLP

(57) ABSTRACT

The present invention provides a magnet structure comprising a first magnet, a second magnet, and an intermediate layer joining the first magnet and the second magnet. In the magnet structure, each of the first magnet and the second magnet is a permanent magnet comprising a rare earth element R, a transition metal element T, and boron B. In addition, the rare earth element R comprises: a light rare earth element $R_L$ comprising at least Nd; and a heavy rare earth element $R_H$, and the transition metal element T comprises Fe, Co, and Cu. Further, the intermediate layer comprises: an $R_L$ oxide phase comprising an oxide of the light rare earth element $R_L$; and an $R_L$—Co—Cu phase comprising the light rare earth element $R_L$, Co, and Cu.

6 Claims, 7 Drawing Sheets

MAGNET STRUCTURE

TECHNICAL FIELD

The present invention relates to a magnet structure of R-T-B based permanent magnets each comprising as main components a rare earth element (R), a transition metal element (T) such as Fe, and boron (B).

BACKGROUND

An R-T-B (R represents at least one rare earth element, and T represents a transition metal element such as Fe) based permanent magnet has excellent magnetic properties but tends to have a low corrosion resistance because it contains as a main component a rare earth element that is easily oxidized.

Therefore, to improve the corrosion resistance, a surface treatment such as resin coating or plating is generally applied on the surface of the R-T-B based permanent magnet in many cases. On the other hand, attempts to improve the corrosion resistance of the magnet itself have been made by changing additional element or elements of the magnet, or changing the internal structure of the magnet. Improving the corrosion resistance of the magnet itself is extremely important for enhancing the product reliability after a surface treatment and also has a merit that product costs can be reduced by enabling a sufficient corrosion resistance to be obtained through the application of a surface treatment that is simpler than resin coating or plating.

Moreover, a high coercivity HcJ is required for a permanent magnet. It is known that the coercivity of the R-T-B based permanent magnet can be improved by allowing the R-T-B based permanent magnet to contain a heavy rare earth element. In addition, as a method for allowing the permanent magnet to contain a heavy rare earth element, a method of diffusing a heavy rare earth element into the inside of the R-T-B based permanent magnet through grain boundaries by allowing the heavy rare earth element to adhere to the surface of the R-T-B based permanent magnet and heating the resultant (grain boundary diffusion method) is known.

For example, Japanese Unexamined Patent Publication No. 2007-258455 discloses that a plurality of R—Fe—B based rare earth sintered magnet bodies is prepared, and these magnet bodies are heated in a state where a foil or powder containing a heavy rare earth element is brought into contact with the magnet bodies in between the magnet bodies, thereby diffusing the heavy rare earth element into the inside of the magnet bodies. In addition, International Publication No. WO 2014/148355 discloses that a grain boundary diffusion treatment is performed by heating a plurality of R—Fe—B based sintered magnets in a state where a paste, obtained by mixing a metal powder containing a heavy rare earth element and an organic substance, is held between the plurality of R—Fe—B based sintered magnets.

SUMMARY

It cannot be said that sufficient corrosion resistance and mechanical strength are obtained in the R—Fe—B based sintered magnet disclosed in Japanese Unexamined Patent Publication No. 2007-258455 and in International Publication No. WO 2014/148355.

The present invention has been completed in consideration of the above-described circumstances and intends to provide a magnet structure whose corrosion resistance and mechanical strength are improved.

The present invention provides a magnet structure comprising: a first magnet; a second magnet; and an intermediate layer joining the first magnet and the second magnet. In the magnet structure, each of the first magnet and the second magnet is a permanent magnet comprising: a rare earth element R; a transition metal element T; and boron B. In addition, the rare earth element R comprises: a light rare earth element $R_L$ comprising at least Nd; and a heavy rare earth element $R_H$, and the transition metal element T comprises Fe, Co, and Cu. Further, the intermediate layer comprises: an $R_L$ oxide phase comprising an oxide of the light rare earth element $R_L$; and an $R_L$—Co—Cu phase comprising the light rare earth element $R_L$, Co, and Cu. According to the present invention, a magnet structure whose corrosion resistance and strength are improved can be provided.

In the magnet structure, it is preferable that the intermediate layer further comprise an $R_L$ rich phase. Thereby, there is a tendency that the magnetic properties of the magnet structure are improved.

In the magnet structure, it is preferable that the concentrations of $R_L$, of Co, and of Cu in the $R_L$—Co—Cu phase be higher than the concentrations of $R_L$, of Co, and of Cu respectively in the magnet. Thereby, there is a tendency that the joining strength of the magnet structure is enhanced, and the corrosion resistance is improved.

In the magnet structure, it is preferable that the first magnet and the second magnet each have a region where the concentration of the heavy rare earth element in the magnet becomes lower as the distance from the intermediate layer becomes larger. Thereby, there is a tendency that the magnetic properties of the magnet structure are further improved.

In the magnet structure, the content of the $R_L$ in the intermediate layer may be higher than the content of the $R_L$ in the first magnet and the content of the $R_L$ in the second magnet.

The magnet structure may further comprise: a third magnet; and another intermediate layer joining the second magnet and the third magnet. Thereby, high magnetic properties can be maintained even when the magnet structure is made thick.

According to the present invention, a permanent magnet whose corrosion resistance and mechanical strength are improved can be provided.

DETAILED DESCRIPTION

Hereinafter, preferred embodiments of the present invention will be described with reference to the accompanying drawings. However, the present invention is not limited to the following embodiments.

Magnet Structure

Figure 1:
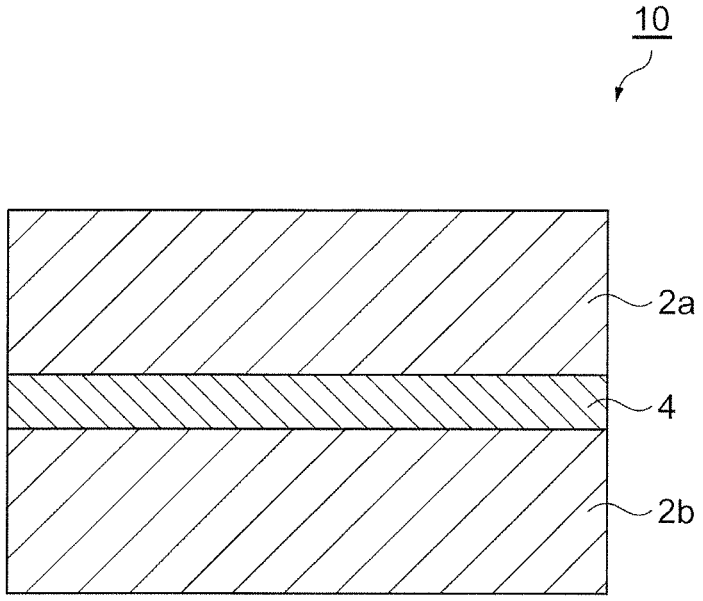
FIG. 1 is a schematic cross-sectional view of a magnet structure according to one embodiment of the present invention.

FIG. 1 is a schematic cross-sectional view of a magnet structure according to one embodiment of the present invention. In FIG. 1, a magnet structure 10 comprises: a first magnet 2*a*; a second magnet 2*b*; and an intermediate layer 4. The intermediate layer 4 is disposed between the first magnet 2*a* and the second magnet 2*b*, and the first magnet 2*a* and the second magnet 2*b* are joined through the intermediate layer 4.

Magnet

Each of the first magnet 2*a* and the second magnet 2*b* (magnet according to the present embodiment) is not particularly limited as long as it is an R-T-B based magnet, but it is preferable that each of the first magnet 2*a* and the second magnet 2*b* be an R-T-B based permanent magnet, and it is more preferable that it be an R-T-B based sintered magnet. In the present embodiment, the R-T-B based sintered magnet will be described as the magnet.

Each of the first magnet 2*a* and the second magnet 2*b* is an R-T-B based sintered magnet comprising: a rare earth element R; a transition metal element T; and boron B.

The rare earth element refers to Sc, Y, and the lanthanoid elements, which belong to the group 3 of the long period type periodic table. Examples of the lanthanoid elements include La, Ce, Pr, Nd, Sm, Eu, Gd, Tb, Dy, Ho, Er, Tm, Yb, and Lu. The rare earth element is classified into a light rare earth element and a heavy rare earth element, the heavy rare earth element $R_H$ refers to Gd, Tb, Dy, Ho, Er, Tm, Yb, or Lu, and the light rare earth element $R_L$ refers to a rare earth element other than these.

In the present embodiment, the R comprises: a light rare earth element $R_L$ comprising at least Nd; and a heavy rare earth element $R_H$. The $R_L$ may further comprise Pr. By allowing the R to contain the heavy rare earth element $R_H$, the coercivity of the magnet can be improved. It is preferable that the $R_H$ comprise at least one of Dy and Tb, and it is more preferable that it comprise Tb. The $R_H$ may further comprise Ho or Gd.

In the present embodiment, the T comprises Fe, Co, and Cu. By allowing the T to contain Co, the temperature properties can be improved without lowering the magnetic properties. In addition, by allowing the T to contain Cu, high coercivity and high corrosion resistance of the resultant magnet and improvement in the temperature properties of the resultant magnet become possible.

Examples of the transition metal element other than Fe, Co, and Cu include Ti, V, Cr, Mn, Ni, Zr, Nb, Mo, Hf, Ta, and W.

Moreover, the magnet according to the present embodiment may further comprise, in addition to R, T, and B, at least one of the elements such as, for example, N, Al, Ga, Si, Bi, and Sn.

The magnet according to the present embodiment has an $R_2T_{14}B$ crystal grain (main phase), and has two-particle grain boundaries formed between two adjacent $R_2T_{14}B$ crystal grains and multi-particle grain boundaries surrounded by three or more adjacent $R_2T_{14}B$ crystal grains. In the present embodiment, the grain boundaries including the two-particle grain boundaries and the multi-particle grain boundaries are referred to as a grain boundary phase. The $R_2T_{14}B$ crystal grain has an $R_2T_{14}B$ type crystal structure consisting of a tetragonal crystal system. The average grain diameter of the $R_2T_{14}B$ crystal grains is usually about 1 μm to about 30 μm.

It is suitable that the magnet according to the present embodiment comprises, in the grain boundary phase, an R rich phase having a higher concentration (mass percentage) of the R than in the $R_2T_{14}B$ crystal grain (main phase). By allowing the grain boundary phase to contain the R rich phase, it becomes easy to exhibit the high coercivity HcJ. Examples of the R rich phase include: a metal phase in which the concentration of the R is higher than that in the main phase, and the concentrations of the T and of B are lower than those in the main phase; a metal phase in which the concentrations of the R, of Co, of Cu and of N are higher than those in the main phase; and oxide phases thereof. Each of the R rich phases may further comprise another element. By allowing the grain boundary phase to contain the R rich phase, there is a tendency that the magnetic properties of the magnet structure, such as coercivity, can be improved.

The grain boundary phase may further comprise a B rich phase in which the concentration of a boron (B) atom is higher than that in the main phase.

It is preferable that the content of Co in the magnet according to the present embodiment be 0.50 to 3.50% by mass, it is more preferable that it be 0.70 to 3.00% by mass, and it is still more preferable that it be 1.00 to 2.50% by mass. In addition, it is preferable that the content of Cu in the magnet according to the present embodiment be 0.05 to 0.35% by mass, it is more preferable that it be 0.07 to 0.30% by mass, and it is still more preferable that it be 0.10 to 0.25% by mass. By allowing the magnet to contain 0.50% by mass or more of Co and 0.05% by mass or more of Cu, it becomes easier to improve the corrosion resistance and the bending strength of the magnet structure 10.

The content of the R in the magnet according to the present embodiment is preferably 25% by mass or more and 35% by mass or less, more preferably 28% by mass or more and 33% by mass or less. When the content of the R is 25% by mass or more, it becomes easier to produce the $R_2T_{14}B$ compound to be a main phase of the magnet sufficiently. In addition, when the content of the R is 35% by mass or less, there is a tendency that the volume fraction of the $R_2T_{14}B$ phase becomes low to enable suppression of lowering the residual magnetic flux density Br.

The magnet according to the present embodiment has a region where the concentration of the heavy rare earth element $R_H$ becomes lower as the distance from the intermediate layer 4 becomes larger ($R_H$ gradient region).

In the magnet according to the present embodiment, the content of the $R_H$ in the R can be, for example, 0.1 to 1.0% by mass. By making the content of the $R_H$ 0.1% by mass or more, there is a tendency that the coercivity of the magnet can be improved. By making the content of the $R_H$ 1.0% by mass or less, there is a tendency that a high coercivity can be obtained while limiting the use of the heavy rare earth elements which are rare from an aspect of resources and are expensive.

The content of B in the magnet according to the present embodiment is preferably 0.5% by mass or more and 1.5% by mass or less, more preferably 0.7% by mass or more and 1.2% by mass or less, and still more preferably 0.7% by mass or more and 1.0% by mass or less. When the content of B is 0.5% by mass or more, there is a tendency that the coercivity HcJ is improved. In addition, when the content of B is 1.5% by mass or less, there is a tendency that the residual magnetic flux density Br is improved. Part of B may be replaced by carbon (C).

Besides, the magnet according to the present embodiment may contain O, C, Ca, and the like unavoidably. Each of these may be contained in an amount of about 0.5% by mass or less.

The content of Fe in the magnet according to the present embodiment is a substantial balance in the constituents of the magnet. By allowing the T to contain Co, the Curie temperature of the magnet is improved, and besides, the corrosion resistance of the grain boundary phase is improved, and therefore the magnet according to the present embodiment has a high corrosion resistance as a whole. In addition, by allowing the T to contain Cu, high coercivity and high corrosion resistance of the magnet and improvement in the temperature properties of the magnet become possible.

The magnet according to the present embodiment may comprise aluminum (Al). By allowing the magnet to contain Al, further high coercivity and high corrosion resistance and further improvement in the temperature properties become possible. The content of Al is preferably 0.03% by mass or more and 0.4% by mass or less, more preferably 0.05% by mass or more and 0.25% by mass or less.

The magnet according to the present embodiment may comprise oxygen (O). The amount of oxygen in the magnet changes depending on other parameters or the like and is appropriately determined, but it is preferably 500 ppm or more from the viewpoint of the corrosion resistance and is preferably 2000 ppm or less from the viewpoint of the magnetic properties.

The magnet according to the present embodiment may comprise carbon (C). The amount of carbon in the magnet changes depending on other parameters or the like and is appropriately determined, but when the amount of carbon is increased, the magnetic properties are lowered.

The magnet according to the present embodiment may comprise nitrogen (N). The content of nitrogen in the magnet is preferably 100 to 2000 ppm, more preferably 200 to 1000 ppm, and still more preferably 300 to 800 ppm.

As the methods for measuring the amount of oxygen, the amount of carbon, and the amount of nitrogen in the magnet, the conventional methods which have generally been known can be used. The amount of oxygen can be measured, for example, by an inert gas fusion-nondispersive infrared absorption method, the amount of carbon can be measured, for example, by an in-oxygen airflow combustion-infrared absorption method, and the amount of nitrogen can be measured, for example, by an inert gas fusion-thermal conductivity method.

The thickness of the magnet according to the present embodiment can be, for example, 0.5 to 10.0 mm, and it is preferable that the thickness of the magnet according to the present embodiment be 0.75 to 7.5 mm, and it is more preferable that it be 1.0 to 5.0 mm. By allowing the thickness of the magnet according to the present embodiment to be within the above-described range, it becomes easier to obtain the $R_H$ gradient region sufficiently, and it becomes easier to improve the magnetic properties.

Intermediate Layer

The intermediate layer 4 comprises an $R_L$ oxide phase and an $R_L$—Co—Cu phase. It is preferable that the intermediate layer 4 further comprise an $R_L$ rich phase.

The $R_L$ oxide phase is a phase comprising an oxide of a light rare earth element $R_L$. The $R_L$ oxide phase may comprise a heavy rare earth element $R_H$. The concentration of the $R_L$ in the $R_L$ oxide phase is, for example, 40 to 90% by mass, and it may be 45 to 85% by mass. In addition, the concentration of oxygen (O) in the $R_L$ oxide phase is, for example, 10 to 30% by mass, and it may be 10 to 25% by mass.

The $R_L$ rich phase is a metal phase mainly comprising the $R_L$. The $R_L$ rich phase may comprise a heavy rare earth element $R_H$. The concentration of the $R_L$ in the $R_L$ rich phase is, for example, 65 to 90% by mass, and it may be 70 to 85% by mass. In addition, the concentration of oxygen (O) in the $R_L$ rich phase is, for example, less than 10% by mass, less than 7% by mass, or less than 5% by mass.

The $R_L$—Co—Cu phase is a metal phase comprising a light rare earth element $R_L$, Co, and Cu. The $R_L$—Co—Cu phase may comprise a heavy rare earth element $R_H$. The concentration of the $R_L$ in the $R_L$—Co—Cu phase is lower than the concentration of the $R_L$ in the $R_L$ rich phase, and the concentrations of Co and of Cu in the $R_L$—Co—Cu phase are higher than the concentrations of Co and of Cu respectively in the $R_L$ rich phase. The concentration of the $R_L$ in the $R_L$—Co—Cu phase is, for example, 45 to 85% by mass, and it may be 50 to 80% by mass. In addition, the concentration of Co in the $R_L$—Co—Cu phase is, for example, 1.0 to 20.0% by mass, and it may be 2.0 to 15.0% by mass. The concentration of Cu in the $R_L$—Co—Cu phase is, for example, 2.0 to 15.0% by mass, and it may be 3.0 to 10.0% by mass. Further, the concentration of oxygen (O) in the $R_L$—Co—Cu phase is, for example, less than 10% by mass, less than 7% by mass, or less than 5% by mass.

The concentration of the $R_L$ in the intermediate layer 4 is higher than the concentration of the $R_L$ in the first magnet and in the second magnet.

It is preferable that the concentrations of the $R_L$, of Co, and of Cu in the $R_L$—Co—Cu phase be higher than the concentrations of the $R_L$, of Co, and of Cu respectively in the first magnet and in the second magnet. By allowing the $R_L$, Co, and Cu to be contained in the $R_L$—Co—Cu phase in the manner as described above, it becomes easy to obtain the effects of the bending strength and the corrosion resistance of the magnet structure 10. The comparison between the concentrations of the $R_L$, of Co, and of Cu can be conducted, for example, by the element analysis in the cross section of the magnet structure 10 using EPMA.

It is preferable that the volume percentage of the $R_L$ oxide phase in the intermediate layer 4 is be, for example, 5 to 75% by volume, and it is more preferable that it be 15 to 65% by volume. By allowing the intermediate layer 4 to contain 5% by volume or more of the $R_L$ oxide phase, it becomes easy to obtain the effects of the bending strength and the corrosion resistance. By allowing the intermediate layer 4 to contain 75% by volume or less of the $R_L$ oxide phase, there is a tendency that lowering the magnetic properties can be suppressed.

In addition, it is preferable that the volume percentage of the $R_L$ rich phase in the intermediate layer 4 be, for example, 0 to 20% by volume, and it is preferable that it be 2.5 to 15% by volume. By allowing the intermediate layer 4 to contain 20% by volume or less of the $R_L$ rich phase, there is a tendency that lowering the bending strength and the corrosion resistance can be suppressed.

Further, it is preferable that the volume percentage of the $R_L$—Co—Cu phase in the intermediate layer 4 be, for example, 30 to 80% by volume, and it is preferable that it be 35 to 75% by volume. By allowing the intermediate layer 4 to contain 30% by volume or more of the $R_L$—Co—Cu phase, it becomes easy to obtain the effects of the bending strength and the corrosion resistance.

It is preferable that the ratio ($V_{RL}/V_{CoCu}$) of the volume $V_{RL}$ of the $R_L$ rich phase to the volume $V_{CoCu}$ of the $R_L$—Co—Cu phase in the intermediate layer 4 be 0.6 or less, and it is more preferable that it be 0.5 or less. When the ratio ($V_R/V_{CoCu}$) is 0.6 or less, the corrosion resistance of the magnet structure 10 can be further improved. In addition, the ratio ($V_{RL}/V_{CoCu}$) may be 0.05 or more. The volume percentage of each phase and the ratio ($V_{RL}/V_{CoCu}$) in the intermediate layer 4 can be each determined as an approximate value by an average value calculated from the area of each phase in SEM images of 20 points or more of cross sections in the intermediate layer 4.

The thickness of the intermediate layer 4 can be about 20 to about 40 μm, and it is preferable that the thickness of the intermediate layer 4 be 25 to 35 μm. In addition, it can also be said that the intermediate layer 4 covers the interface between the first magnet 2*a* and the second magnet 2*b*. In this case, it is preferable that the coverage of the interface by the intermediate layer 4 be 70% or more, it is more preferable that it be 80% or more, it is still more preferable that it be 90% or more, and it is particularly preferable that it be 95% or more. By setting the thickness to 20 μm or more and the coverage to 70% or more, it becomes further easier to obtain the effects of the corrosion resistance and the bending strength. The main phase in the magnet or a pore phase exists in the uncovered portion.

The content of the $R_H$ in the whole magnet structure 10 can be 0.1 to 1.0% by mass. By setting the content of the $R_H$ to 0.1% by mass or more, there is a tendency that the coercivity of the magnet can be improved. By setting the content of the $R_H$ to 1.0% by mass or less, there is a tendency that a high coercivity can be obtained while limiting the use of the heavy rare earth elements which are rare from an aspect of resources and are expensive. In the magnet structure 10, the content of the $R_L$ in the intermediate layer 4 may be higher than the content of the $R_L$ in the first magnet 2*a* and in the second magnet 2*b*.

Mechanism

In the magnet structure comprising an intermediate layer comprising a larger amount of the $R_L$ than the first magnet and the second magnet, such as the present embodiment, the amount of the $R_L$ rich phase in the intermediate layer becomes relatively large, and therefore the intermediate layer easily undergoes corrosion by water.

Specifically, since the $R_L$ rich phase easily undergoes oxidation, the $R_L$ in the $R_L$ rich phase that exists in the grain boundaries is oxidized by water such as water vapor in a use environment to be corroded and changed into a hydroxide, and hydrogen is generated in the process of the change.

$$2R_L+6H_2O \rightarrow 2R_L(OH)_3+3H_2 \quad \text{(I)}$$

Subsequently, this generated hydrogen is stored in the $R_L$ rich phase that has not been corroded.

$$2R_L+xH_2 \rightarrow 2R_LH_x \quad \text{(II)}$$

The $R_L$ rich phase becomes more easily oxidized as a result of hydrogen storage, and corrosion reaction between the $R_L$ rich phase, which has stored hydrogen, and water generates hydrogen in an amount equal to or more than the amount of hydrogen stored in the $R_L$ rich phase.

$$2R_LH_x+6H_2O \rightarrow 2R_L(OH)_3+(3+x)H_2 \quad \text{(III)}$$

The corrosion of the $R_L$ rich phase progresses into the inside of the intermediate layer, the first magnet, and the second magnet through the chain reaction of (I) to (III), so that the $R_L$ rich phase changes into an $R_L$ hydroxide and a hydrogenated product of the $R_L$. Stress is accumulated due to the volume expansion accompanying this change, resulting in drop out of the crystal grains (main phase particles) that constitute the main phase of the R-T-B based permanent magnet and occurrence of cracks between the intermediate layer 4 and the first magnet, and between the intermediate layer 4 and the second magnet. Newly formed surfaces containing the $R_L$ rich phase appear due to these, so that the corrosion further progresses.

In the present embodiment, the water corrosion resistance of the $R_L$—Co—Cu phase contained in the intermediate layer is stronger than that of the $R_L$ rich phase. Accordingly, by allowing the intermediate layer 4 to contain the $R_L$—Co—Cu phase, penetration of water such as water vapor in a use environment into the inside of the intermediate layer 4 from the side surface and the reaction of the water with the $R_L$ in the $R_L$ rich phase may be suppressed effectively, thereby enabling suppression of the progress of the corrosion of the $R_L$ rich phase inside. Accordingly, the corrosion resistance of the magnet structure 10 can be improved, and satisfactory magnetic properties can be obtained. Further, by allowing the intermediate layer 4 to comprise the $R_L$ oxide phase and the $R_L$—Co—Cu phase, the joining force between the first magnet 2*a* and the second magnet 2*b* can be improved more than in the case where the intermediate layer 4 does not comprise these and comprises a larger amount of the $R_L$ rich phase, so that the bending strength of the magnet structure 10 can be improved.

The magnet structure having two magnets (first magnet and second magnet) has been described above; however, the magnet structure may be constituted using three or more magnets (first magnet to third magnet), and in this case, the adjacent magnets are joined through an intermediate layer similar to that described above.

Figure 2:
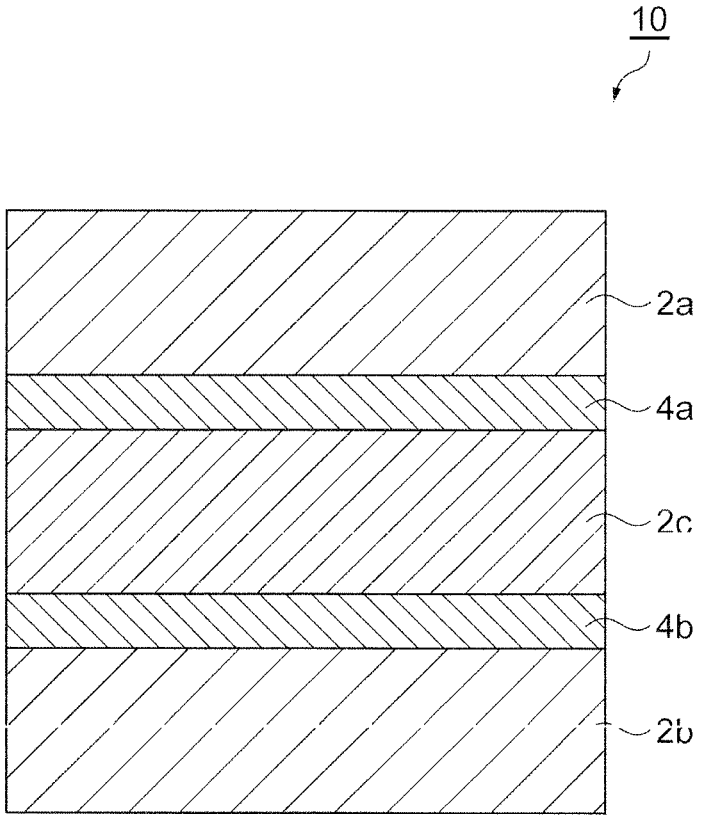
FIG. 2 is a schematic cross-sectional view of a magnet structure according to another embodiment of the present invention.

For example, FIG. 2 is a schematic cross-sectional view of a magnet structure according to another embodiment of the present invention. In FIG. 2, the magnet structure 10 comprises a first magnet 2*a*, a second magnet 2*b*, a third magnet 2*c*, a first intermediate layer 4*a*, and a second intermediate layer 4*b*. The first intermediate layer 4*a* is disposed between the first magnet 2*a* and the third magnet 2c, and the first magnet 2a and the third magnet 2c are joined through the first intermediate layer 4a. In addition, the intermediate layer 4b is disposed between the second magnet 2b and the third magnet 2c, and the second magnet 2b and the third magnet 2c are joined through the intermediate layer 4b.

The first magnet 2a and the second magnet 2b in FIG. 2 can be the same as the first magnet 2a and the second magnet 2b in FIG. 1, and these magnets constitute the outermost surfaces of the magnet structure 10 in the present embodiment. In addition, the first intermediate layer 4a and the second intermediate layer 4b in FIG. 2 can be the same as the intermediate layer 4 in FIG. 1. The third magnet 2c in FIG. 2 is disposed in such a way as to be interposed between the first magnet 2a and the second magnet 2b through the first intermediate layer 4a and the second intermediate layer 4b. Therefore, the third magnet 2c is different from the first magnet 2a and the second magnet 2b in that the third magnet 2c has a region where the concentration of the heavy rare earth element $R_H$ becomes lower as the distance from both the first intermediate layer 4a and the second intermediate layer 4b becomes larger. In this way, by making the magnet structure into a multilayer structure using three or more magnets, the heavy rare earth element $R_H$ can be diffused into the magnets even when the magnet structure is designed to be thick, so that it becomes easy to obtain excellent magnetic properties.

Method for Producing Magnet Structure

The magnet structure 10 is produced, for example, through the following steps.

(A) A magnet preparation step (step S1) of preparing R-T-B based sintered magnets as a first magnet and a second magnet (B) A paste preparation step (step S2) of preparing a paste comprising a heavy rare earth element $R_H$ (diffusion material paste)

Figure 3A:
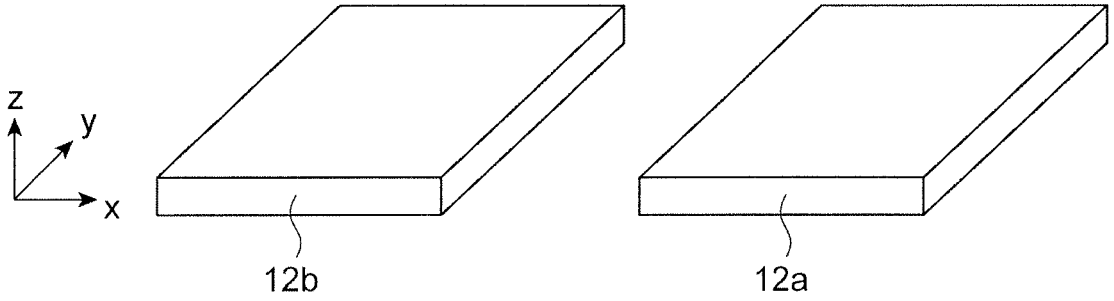
FIG. 3A is a perspective view illustrating a magnet structure according to one embodiment of the present invention and a step of producing the same, and illustrates a magnet preparation step of preparing R-T-B based sintered magnets as a first magnet and a second magnet.
Figure 3B:
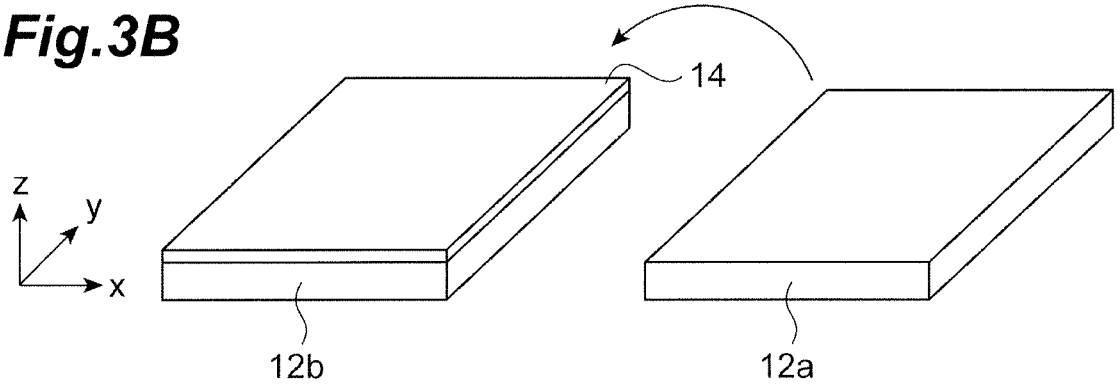
FIG. 3B is a perspective view illustrating a magnet structure according to one embodiment of the present invention and a step of producing the same, and illustrates a lamination step of superimposing the first magnet on the second magnet with a diffusion material paste applied thereon.
Figure 3C:
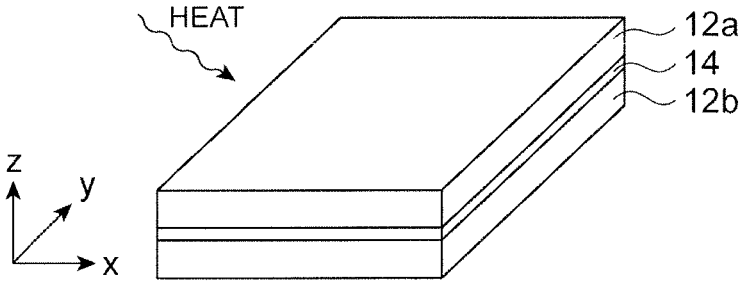
FIG. 3C is a perspective view illustrating a magnet structure according to one embodiment of the present invention and a step of producing the same, and illustrates a heating step of heating a laminated body.
Figure 3D:
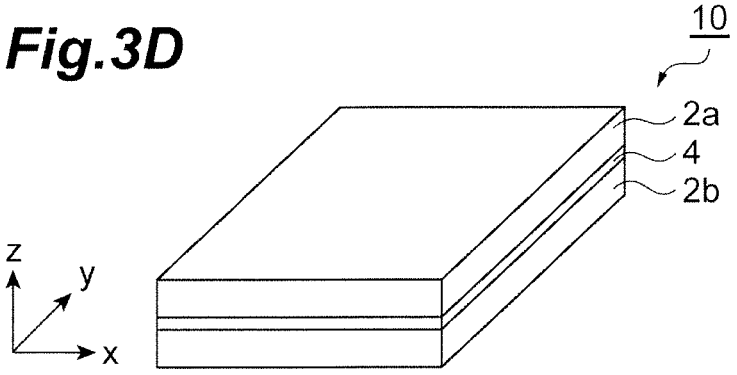
FIG. 3D is a perspective view illustrating a magnet structure according to one embodiment of the present invention and a step of producing the same, and illustrates a magnet structure obtained through the above-described steps.

(C) A lamination step (step S3) of applying the diffusion material paste on a main surface of the second magnet to form a coating film, and superimposing the first magnet on the coating film, thereby obtaining a laminated body (D) A heating step (step S4) of heating the laminated body, thereby obtaining a magnet structure (E) A surface treatment step (step S5) of performing a surface treatment of the magnet structure In addition, each of FIG. 3A to FIG. 3D is a perspective view illustrating steps of producing a magnet structure according to one embodiment of the present invention, FIG. 3A illustrates the magnet preparation step (step S1) of preparing the R-T-B based sintered magnets as the first magnet and the second magnet, FIG. 3B illustrates the lamination step (step S3) of superimposing the first magnet on the second magnet on which the diffusion material paste is applied, FIG. 3C illustrates the heating step (step S4) of heating the laminated body, and FIG. 3D illustrates the magnet structure obtained through the above-described steps. Hereinafter, each step will be described with reference to the accompanying drawings if necessary.

Magnet Preparation Step: Step S1

Firstly, a first magnet 12a and a second magnet 12b are prepared. The first magnet 12a and the second magnet 12b as referred to herein mean magnets, as the base materials before the heating step, to be the first magnet 2a and the second magnet 2b respectively in the magnet structure 10. Accordingly, it can be said that the first magnet 12a is a first base material, and the second magnet 12b is a second base material. Each of the first magnet 12a and the second magnet 12b is an R-T-B based sintered magnet, and may be the same with or different from the other. The R in the magnet herein comprises the $R_L$ but may comprise the $R_H$ in addition to the $R_L$. The magnet may be prepared by buying a commercially available magnet, and, for example, may be prepared by being produced according to the following method. The method for producing the magnet comprises, for example, the following steps.

(a) An alloy preparation step of preparing a first alloy and a second alloy (b) A pulverization step of pulverizing the first alloy and the second alloy (c) A mixing step of mixing a first alloy powder and a second alloy powder (d) A molding step of molding a mixed powder having been mixed to obtain a green compact (e) A sintering step of sintering the green compact, thereby obtaining an R-T-B based sintered magnet (f) An aging treatment step of performing an aging treatment on the R-T-B based sintered magnet (g) A cooling step of cooling the R-T-B based sintered magnet (h) A processing step of processing the R-T-B based sintered magnet In the method for producing the magnet, the first alloy for mainly forming a main phase and the second alloy for mainly forming a grain boundary phase are prepared (alloy preparation step). In the alloy preparation step, raw material metals corresponding to the composition of the R-T-B based sintered magnet are melt in a vacuum or in an inert gas atmosphere of an inert gas such as an Ar gas, and then casting is performed using the molten raw material metals, thereby preparing the first alloy and the second alloy each having a desired composition. A two-alloy method, in which two alloys of the first alloy and the second alloy are mixed to prepare a raw material powder, will be described hereinafter, but a one-alloy method, in which a single alloy is used without using the first alloy and the second alloy separately, may be used.

As the raw material metal, for example, rare earth metals, rare earth alloys, pure iron, ferro-boron, and alloys and compounds thereof can be used. Examples of the casting method for casting the raw material metal include an ingot casting method, a strip casting method, a book molding method, or a centrifugal casting method.

After the first alloy and the second alloy are prepared, the first alloy and the second alloy are pulverized (pulverization step). In the pulverization step, after the first alloy and the second alloy are prepared, these first alloy and second alloy are pulverized separately to make a powder. The first alloy and the second alloy may be pulverized together. Through the pulverization step, the alloy is pulverized till the grain diameter reaches about several μm.

After the first alloy and the second alloy are pulverized, respective alloy powders are mixed in a low oxygen atmosphere (mixing step). Thereby, a mixed powder is obtained. The low oxygen atmosphere is formed, for example, as an inert gas atmosphere such as a $N_2$ gas or Ar gas atmosphere. It is preferable that the blending ratio of the first alloy powder to the second alloy powder be 80 to 20 or more and 97 to 3 or less in terms of a mass ratio, and more preferably it is 90 to 10 or more and 97 to 3 or less in terms of a mass ratio.

After the first alloy powder and the second alloy powder are mixed, the mixed powder is molded into an intended shape (molding step). In the molding step, the mixed powder of the first alloy powder and the second alloy powder is filled into a press mold to be pressurized, and thus the mixed powder is molded into an arbitrary shape. In molding the mixed powder, molding is performed while applying a magnetic field, causing predetermined alignment to the raw material powder by the application of the magnetic field, and thus molding in the magnetic field is performed in a state where crystal axes are aligned. Thereby, a green compact is obtained. The resultant green compact aligns into a particular direction, and therefore the R-T-B based sintered magnet having a higher magnetic anisotropy is obtained.

The resultant green compact is sintered in a vacuum or in an inert gas atmosphere to obtain the R-T-B based sintered magnet (sintering step). The sintering temperature needs to be adjusted according to various conditions such as the composition, the pulverization method, and the difference in the particle size and in the particle size distribution; however, the green compact is sintered by performing a treatment of heating the green compact, for example, at 1000° C. or more and 1200° C. or less for 1 hour or more and 10 hours or less in a vacuum or in the presence of an inert gas. Thereby, the mixed powder undergoes liquid phase sintering to obtain the R-T-B based sintered magnet (sintered body of R-T-B based magnet) the main phase of which has an improved volume fraction. After the green compact is sintered, it is preferable that the sintered body be cooled rapidly from the viewpoint of improving the production efficiency.

By, for example, holding the resultant R-T-B based sintered magnet at a temperature that is lower than the temperature during sintering, an aging treatment is performed on the R-T-B based sintered magnet (aging treatment step). In the aging treatment, the treatment conditions are appropriately adjusted according to the number of times of performing the aging treatment, such as, for example, two-step heating of heating at a temperature of 700° C. or more and 900° C. or less for 1 hour to 3 hours and further heating at a temperature of 500° C. to 700° C. for 1 hour to 3 hours, and one-step heating of heating at a temperature of around 600° C. for 1 hour to 3 hours. Through such an aging treatment, the magnetic properties of the R-T-B based sintered magnet can be improved.

After the aging treatment is performed on the R-T-B based sintered magnet, rapid cooling is performed on the R-T-B based sintered magnet in an Ar gas atmosphere (cooling step). Thereby, the R-T-B based sintered magnet as the first magnet 12*a* or the second magnet 12*b* can be obtained. The cooling speed is not particularly limited; however, it is preferable that the cooling speed be set to 30° C./min or more.

If necessary, the resultant R-T-B based sintered magnet may be processed into a desired shape (processing step). Examples of the processing method include forming processing, such as cutting and grinding, and chamfering processing, such as barrel polishing. The content of each element in the first magnet and in the second magnet thus obtained are appropriately designed so that each of the first magnet 2*a* and the second magnet 2*b* in the magnet structure 10 can have the above-described composition.

The shapes of the first magnet 12*a* and of the second magnet 12*b* are not particularly limited and can be made in an arbitrary shape, such as: a rectangular parallelepiped, a hexahedron, tabular shape, and columnar shapes including a quadrangular prism; a shape such that the cross section of the R-T-B based sintered magnet is C-shaped, and a cylindrical shape. It is preferable that each of the first magnet 12*a* and the second magnet 12*b* have a substantially flat surface that is to be a joining surface so that it can be joined with the other through a diffusion material paste.

Paste Preparation Step: Step S2

In the paste preparation step (step S2), a paste comprising a heavy rare earth element $R_H$ (diffusion material paste) is prepared. The method for preparing the diffusion material paste comprises, for example, the following steps.

(a) A coarse pulverization step of coarsely pulverizing a heavy rare earth element metal, thereby obtaining a heavy rare earth element particle (b) An oxygen adsorption step of allowing oxygen to adsorb to a surface of the heavy rare earth element particle, thereby obtaining an oxygen adsorbed heavy rare earth element particle (c) A mixing step of obtaining a heavy rare earth element-containing paste In the coarse pulverization step, the heavy rare earth element $R_H$ metal is first prepared. This heavy rare earth element $R_H$ metal is coarsely pulverized till the grain diameter reaches about several hundred μm to about several mm. Thereby, a coarsely pulverized powder (heavy rare earth element particle) of the heavy rare earth element $R_H$ metal is obtained. The coarse pulverization can be performed by allowing the heavy rare earth element $R_H$ metal to store hydrogen, and then releasing hydrogen based on the difference in the amount of hydrogen stored between different phases to perform dehydrogenation, thereby causing self-collapsing pulverization (pulverization through hydrogen storage). On this occasion, a hydrogenated heavy rare earth element particle is obtained together with the heavy rare earth element metal particle.

The coarse pulverization step may be performed using a coarse pulverizer, such as a stamp mill, a jaw crusher, and a brown mill, in an inert gas atmosphere in place of using the pulverization through hydrogen storage as described above.

In the oxygen adsorption step, after the heavy rare earth element $R_H$ metal is coarsely pulverized, the resultant heavy rare earth element particle is finely pulverized till the average particle diameter reaches about several μm. Thereby, a finely pulverized powder of the heavy rare earth element particle is obtained. By finely pulverizing the coarsely pulverized powder, a finely pulverized powder containing a particle of preferably 1 μm or more and 10 μm or less, more preferably 3 μm or more and 5 μm or less can be obtained. The fine pulverization is performed in an atmosphere containing 3000 to 10000 ppm of oxygen. This enables oxygen to adsorb to the surface or the like of the heavy rare earth element particle, and thus an oxygen adsorbed heavy rare earth element particle can be obtained.

The fine pulverization is performed by further pulverizing a coarsely pulverized powder using a fine pulverizer, such as a jet mill, a ball mill, a vibration mill, and a wet type attritor, while appropriately adjusting conditions such as pulverization time and the like. The jet mill is a method of performing pulverization in such a way that a high-speed gas flow is generated by releasing a high-pressure inert gas (for example, $N_2$ gas) having an oxygen concentration in the above-described range from a narrow nozzle, and the heavy rare earth element particle is accelerated by this high-speed gas flow to cause collision between the heavy rare earth element particles and the collision with a target or a container wall.

A finely pulverized powder that exhibits a high orientation at the time of shaping can be obtained by adding a pulverizing agent, such as zinc stearate and oleic amide, in finely pulverizing the heavy rare earth element particle.

After oxygen is allowed to adsorb to the surface of the heavy rare earth element particle, the oxygen adsorbed heavy rare earth element particle is mixed with a solvent, and a binder or the like in the mixing step. Thereby, a heavy rare earth element-containing paste (also referred to as diffusion material paste) is obtained. It is suitable that an oxygen-containing compound, such as silicone grease, and oils and fats, is not mixed into the diffusion material paste. When the amount of the oxygen-containing compound becomes large, the amount of oxygen in the intermediate layer becomes large, so that there is a tendency that the $R_L$ oxide phase is formed earlier and the $R_L$—Co—Cu phase is not formed.

Examples of the solvent for use in the diffusion material paste include aldehydes, alcohols, and ketones. In addition, examples of the binder include acrylic resins, urethane resins, butyral resins, natural resins, and cellulose resins. The content of the heavy rare earth element $R_H$ in the diffusion material paste can be, for example, 40 to 90% by mass, and it may be 50 to 80% by mass.

Lamination Step: Step S3

In the lamination step (step S3), as illustrated in FIG. 3B, the diffusion material paste is applied on the main surface of the second magnet 12*b*, and a coating film 14 derived from the diffusion material paste is formed. In the case where the diffusion material paste contains a solvent, drying by heating is performed to remove the solvent after the application. Further, the first magnet 12*a* is superimposed on the coating film 14 in the z direction in the FIG. 3B to obtain a laminated body. The thickness of the coating film 14 derived from the diffusion material paste can be, for example, 10 to 80 μm, and it may be 20 to 50 μm. By changing the thickness of the coating film 14, the content of the heavy rare earth element $R_H$ in the magnet structure 10 can be adjusted; however, the magnet structure 10 having excellent magnetic properties can also be obtained by thinning the coating film 14 as described above to reduce the content of the heavy rare earth element $R_H$.

Heating Step: Step S4

In the heating step (step S4), as illustrated in FIG. 3C, the laminated body obtained through the lamination step is heated. The heating is performed, for example, in a vacuum or in an inert gas atmosphere, and comprises: first heating for diffusing the heavy rare earth element; and second heating for improving the coercivity. In the first heating, the temperature is, for example, 800 to 1000° C., and the time is 10 minutes to 48 hours. In addition, in the second heating, the temperature is, for example, 500 to 600° C., and the time is 1 to 4 hours. Further, the heating may be performed while pressurizing the laminated body vertically in the z direction in the FIG. 3C. By allowing the heating to be performed with the pressurization, there is a tendency that the joining strength between the magnets of the magnet structure is enhanced. By heating the laminated body obtained through the lamination step, the magnet structure 10 is obtained as illustrated in FIG. 3D.

The heavy rare earth element $R_H$ in the diffusion material paste diffuses into the first magnet 12*a* and the second magnet 12*b* toward the z direction in FIG. 3C by the first heating. In addition, the light rare earth element $R_L$, Co, Cu, and the like in the first magnet 12*a* and the second magnet 12*b* are supplied to the portion where the diffusion material paste existed in such a way as to be exchanged for the diffused heavy rare earth element $R_H$. As a result, in the first magnet 2*a* and the second magnet 2*b* in the resultant magnet structure 10, a region where the concentration of the heavy rare earth element $R_H$ becomes lower ($R_H$ gradient region) as the distance (in the z direction in FIG. 3D) from the intermediate layer 4 becomes larger is generated. In addition, the intermediate layer 4 is formed between the first magnet 2*a* and the second magnet 2*b* by the light rare earth element $R_L$, Co, Cu, and the like supplied from the first magnet 12*a* and the second magnet 12*b*.

In the paste preparation step (step S2), oxygen is allowed to adsorb to the heavy rare earth element particle by finely pulverizing the heavy rare earth element in the oxygen-containing atmosphere. In this way, by allowing a certain amount of oxygen to exist in the diffusion material paste, the light rare earth element $R_L$ in the first magnet 12*a* and the second magnet 12*b* tends to exist as an oxide, so that the intermediate layer 4 comprises an $R_L$ oxide phase. On the other hand, by not allowing an excessive amount of oxygen in the diffusion material paste to exist, oxidation of the heavy rare earth element $R_H$ in the diffusion material paste during heating is suppressed, thereby enabling the diffusion of the heavy rare earth element $R_H$ into the magnets to be facilitated. It is considered that this is because when the heavy rare earth element $R_H$ is oxidized, the melting point becomes high to make it hard for the heavy rare earth element to melt and diffuse at a temperature in the first heating. In addition, by not allowing an excessive amount of oxygen in the diffusion material paste to exist, oxidation of Co and of Cu is suppressed so that the intermediate layer 4 tends to comprise the $R_L$—Co—Cu phase. The $R_L$ rich phase is also formed in the intermediate layer 4. In this way, by controlling the amount of oxygen in the diffusion material paste, it is realized to suppress the oxidation of Co and Cu and deposit the $R_L$—Co—Cu phase while obtaining an oxide of the light rare earth element $R_L$ ($R_L$ oxide phase) in the intermediate layer 4. This utilizes a characteristic that the light rare earth element $R_L$ is more easily oxidized than Co and Cu.

Surface Treatment Step: Step S5

On the magnet structure 10 obtained through the above-described steps, a surface treatment by plating, resin coating, an oxidation treatment, a chemical conversion treatment, or the like may be performed. Thereby, the corrosion resistance of the magnet structure 10 can be further improved.

The magnet structure 10 according to the present embodiment can be used over a long period of time because of a high corrosion resistance, and therefore has a high reliability when used as a magnet for a rotary machine such as a motor. The magnet structure 10 according to the present embodiment is suitably used, for example, as a magnet for a surface permanent magnet motor (SPM) in which a magnet is attached on the surface of the rotor, an interior permanent magnet motor (IPM) in which a magnet is embedded inside the rotor, a PRM (Permanent Magnet Reluctance Motor), or the like. Specifically, the magnet structure 10 according to the present embodiment is suitably used for applications such as a hard disk rotary drive spindle motor and a voice coil motor of hard disk drives, a motor for electric automobiles and hybrid cars, an electric power steering motor for automobiles, a servo motor of machine tools, a vibrator motor for cellular phones, a motor for printers, and a motor for generators.

EXAMPLES

Hereinafter, the present invention will be described in more detail based on examples, but the present invention is not limited to the following examples.

Preparation of Sintered Magnet

A raw material alloy was first prepared by a strip casting method so as to obtain a sintered magnet having a magnet composition (% by mass) shown in Table 1. In Table 1, bal. denotes the balance when the whole magnet composition was assumed to be 100% by mass, and $R_L$ represents the total % by mass of Nd and Pr each being a light rare earth element.

TABLE 1

| | Nd | Pr | $R_L$ | Co | Al | Cu | Zr | B | Fe |
|---|---|---|---|---|---|---|---|---|---|
| Magnet composition | 23.6 | 7.4 | 31.0 | 2.0 | 0.2 | 0.2 | 0.15 | 0.98 | bal. |

Subsequently, hydrogen was stored in the raw material alloy at room temperature, and a hydrogen pulverization treatment (coarse pulverization) of performing dehydrogenation at 600° C. for 1 hour in an Ar atmosphere was performed.

In the present example, respective steps from this hydrogen pulverization treatment to sintering (fine pulverization and shaping) were performed in an Ar atmosphere with an oxygen concentration being less than 50 ppm (same applies to the following examples and comparative examples).

Subsequently, 0.1% by mass of zinc stearate was added as a pulverizing agent to the coarsely pulverized powder after the hydrogen pulverization and before performing fine pulverization, and the resultant was mixed with a nauta mixer. Thereafter, fine pulverization was performed using a jet mill to prepare a finely pulverized powder having an average particle diameter of about 4.0 μm.

The resultant finely pulverized powder was filled into a press mold to perform molding in a magnetic field, in which a pressure of 120 MPa was applied while applying a magnetic field of 1200 KA/m, and thus a green compact was obtained.

Thereafter, the resultant green compact was held at 1060° C. for 4 hours in a vacuum to be sintered and was then rapidly cooled to obtain a sintered body (R-T-B based sintered magnet) having a magnet composition shown in Table 1. A two-stage aging treatment at 850° C. for 1 hour and at 540° C. for 2 hours (both in Ar atmosphere) was performed on the resultant sintered body to obtain a sintered magnet as a base material for use in Examples and Comparative Examples.

Preparation of Magnet Structure

Example 1

A hydrogen pulverization treatment (coarse pulverization) of performing dehydrogenation at 600° C. for 1 hour in an Ar atmosphere was performed on a Tb metal (purity of 99.9%) as a heavy rare earth element $R_H$. Subsequently, 0.1% by mass of zinc stearate was added as a pulverization agent to the coarsely pulverized powder, and the resultant was mixed using a nauta mixer. Thereafter, fine pulverization was performed using a jet mill in an atmosphere containing 3000 ppm of oxygen to prepare a finely pulverized powder having an average particle diameter of about 4.0 μm. To 75 parts by mass of the finely pulverized powder, 23 parts by mass of an alcohol as a solvent and 2 parts by mass of an acrylic resin as a binder were added to prepare a diffusion material paste.

Three pieces of magnets each obtained by machining the sintered magnet obtained in the manner as described above into a size of 50 mm in length×30 mm in width×4 mm in thickness were prepared. Each magnet was washed with 0.3% nitric acid aqueous solution and was then washed with water and dried. The above-described diffusion material paste was applied on the surface and the back surface of one piece among the three pieces of magnets, and the magnet after the application was left to stand in an oven of 160° C. to remove the solvent in the paste. The thickness of the coating film of the paste was 20 μm for both the surface and the back surface. The magnet with the coating films formed thereon was interposed between the other two magnets, and these magnets were superimposed to obtain a laminated body. The laminated body was heated at 900° C. for 6 hours in an Ar atmosphere with a load of 100 g being applied from above (first heating). The laminated body after the first heating was further heated at 540° C. for 2 hours in an Ar atmosphere (second heating) to obtain a magnet structure of Example 1. Table 2 shows the content of Co and of Cu in the magnet, the size of the magnet, the number of the magnets, the form of the diffusion material, the diffusion material content in the coating film, and the thickness of the coating film. In Table 2, "pc" is an abbreviation of "piece" and denotes the number of pieces of magnets.

Examples 2 to 7

Magnet joined bodies of Examples 2 to 7 were each obtained in the same manner as in Example 1 except that the content (% by mass) of Co and of Cu in the sintered magnet composition was made so as to be as described in the following Table 2.

Comparative Example 1

One piece of a magnet is prepared by machining the sintered magnet into a size of 50 mm in length×30 mm in width×12 mm in thickness. The same diffusion material paste as the diffusion material paste used in Example 1 was applied on the surface and the back surface of the magnet, and a magnet of Comparative Example 1 was obtained in the same manner as in Example 1 except that the other magnets were not laminated and that the load was not applied during the heat treatment. The thickness of the coating film of the paste was 20 μm for both the surface and the back surface.

Comparative Example 2

A magnet of Comparative Example 2 was obtained in the same manner as in Comparative Example 1 except that a change was made so that the content (% by mass) of Co and of Cu in the sintered magnet composition was as described in the following Table 2.

Comparative Example 3

Three pieces of magnets were each prepared by machining the sintered magnet obtained in Example 2 into a size of 50 mm in length×30 mm in width×4 mm in thickness. Each magnet was washed with 0.3% nitric acid aqueous solution and was then washed with water and dried. A Tb foil having a thickness of 20 μm was displaced on each of the surface and the back surface of one piece among the three pieces of magnets, these were interposed between the other two magnets, and these magnets were superimposed to obtain a laminated body. The laminated body was heated at 900° C. for 6 hours in an Ar atmosphere with a load of 100 g being applied from above (first heating). The laminated body after the first heating was further heated at 540° C. for 2 hours in an Ar atmosphere (second heating) to obtain a magnet structure of Comparative Example 3.

Comparative Examples 4 and 5

Magnet joined bodies of Comparative Examples 4 and 5 were each obtained in the same manner as in Comparative Example 3 except that a change was made so that the content (% by mass) of Co and of Cu in the sintered magnet composition was as described in the following Table 2.

Comparative Example 6

A magnet structure of Comparative Example 6 was obtained in the same manner as in Example 1 except that in the preparation of the diffusion material paste, 5 parts by mass of silicone grease based on 75 parts by mass of the finely pulverized powder was used as a binder in place of the acrylic resin and that the thickness of the coating film was changed to 25 μm.

TABLE 2

| | Co (% by mass) | Cu (% by mass) | Size of base material and number of base materials | Form of diffusion material | Thickness of coating film or foil (μm) |
|---|---|---|---|---|---|
| Example 1 | 2.00 | 0.20 | (50 × 30 × 4 mm) × 3pc | Slurry | 20/20 |
| Example 2 | 1.00 | 0.10 | (50 × 30 × 4 mm) × 3pc | Slurry | 20/20 |
| Example 3 | 0.70 | 0.07 | (50 × 30 × 4 mm) × 3pc | Slurry | 20/20 |
| Example 4 | 1.70 | 0.17 | (50 × 30 × 4 mm) × 3pc | Slurry | 20/20 |
| Example 5 | 2.20 | 0.10 | (50 × 30 × 4 mm) × 3pc | Slurry | 20/20 |
| Example 6 | 0.90 | 0.25 | (50 × 30 × 4 mm) × 3pc | Slurry | 20/20 |
| Example 7 | 3.00 | 0.30 | (50 × 30 × 4 mm) × 3pc | Slurry | 20/20 |
| Comparative Example 1 | 2.00 | 0.20 | 50 × 30 × 12 mm | Slurry | 20/20 |
| Comparative Example 2 | 1.00 | 0.10 | 50 × 30 × 12 mm | Slurry | 20/20 |
| Comparative Example 3 | 1.00 | 0.10 | (50 × 30 × 4 mm) × 3pc | Foil | 20/20 |
| Comparative Example 4 | 0.70 | 0.07 | (50 × 30 × 4 mm) × 3pc | Foil | 20/20 |
| Comparative Example 5 | 2.00 | 0.20 | (50 × 30 × 4 mm) × 3pc | Foil | 20/20 |
| Comparative Example 6 | 2.00 | 0.20 | (50 × 30 × 4 mm) × 3pc | Slurry | 25/25 |

Evaluation of Magnet Structure

Element Distribution in Intermediate Layer

The distribution of elements was analyzed for the joining portion in the cross section of the magnet joined bodies and the like obtained in Examples and Comparative Examples with an electron beam microanalyzer (EPMA, manufactured by JEOL Corporation, trade name: JXA8500F FE-EPMA). Table 3 shows the concentration (% by mass) of Tb as a diffusion material $R_H$ in the whole magnet structure, and whether the $R_L$ oxide phase, the $R_L$—Co—Cu phase, and the $R_L$ rich phase exist or not in the intermediate layer.

Thickness of Intermediate Layer

The central portion of the magnet joined bodies and the like obtained in Examples and Comparative Examples was machined into a size of 10 mm in length×10 mm in width, and the machined magnet structure was embedded in a resin to perform surface polishing of the cross section of the magnet structure. The joining portion in the cross section of the magnet structure after being polished was observed at 500 magnifications with a scanning electron microscope (SEM, manufactured by Hitachi High-Technologies Corporation, trade name: TM3030Plus). The thickness of the intermediate layer on the observation screen was measured at 20 points using image analysis software (PIXS2000pro) to calculate the average value. Table 3 shows the average value of the thickness of the intermediate layer for visual fields of N=10. In the "Thickness of intermediate layer" column for Comparative Examples 1 and 2 in Table 3, the thickness of the layer formed on both surfaces of the magnet, not the intermediate layer, is described.

Coverage by Intermediate Layer

Figure 4:
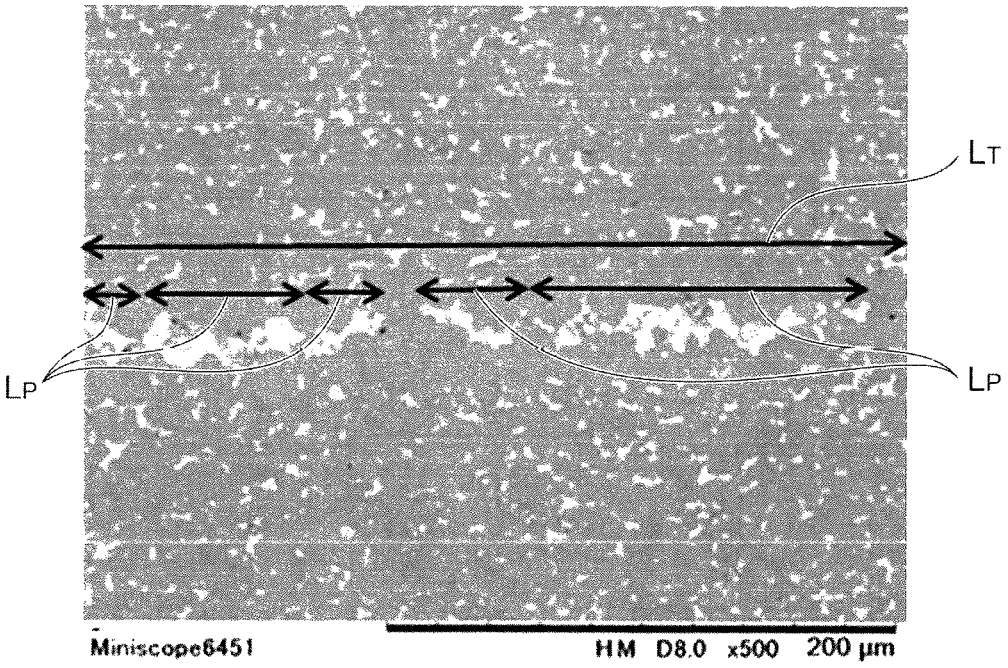
FIG. 4 is a reference diagram for describing a method for measuring a coverage of a magnet structure by an intermediate layer.

The central portion of the magnet joined bodies and the like obtained in Examples and Comparative Examples was machined into a size of 10 mm in length×10 mm in width, and the machined magnet structure was embedded in a resin to perform surface polishing of the cross section of the magnet structure. The joining portion in the cross section of the magnet structure after being polished was observed at 500 magnifications with a scanning electron microscope (SEM, manufactured by Hitachi High-Technologies Corporation, trade name: TM3030Plus). FIG. 4 is a reference diagram for describing a method for measuring a coverage of a magnet structure by an intermediate layer (in Comparative Examples 1 and 2, layer formed on both surfaces of magnet). The sum of the length $L_P$ of a white portion (corresponding to intermediate layer) mainly derived from the light rare earth element in the plane direction of the magnet was measured using image analysis software (PIXS2000pro) to determine the ratio of the length $L_P$ to the total length $L_T$ in the plane direction of the magnet in the observation screen $((L_P/L_T)\times100)$, and the ratio was determined to be the coverage of the interface between the magnets by the intermediate layer. Table 3 shows the coverage by the intermediate layer.

Bending Strength

The magnet joined bodies and the like obtained in Examples and Comparative Examples were each machined into a size of 40 mm in length×10 mm in width. The bending strength of each magnet structure after being machined was measured based on the testing method for three-point flexural strength described in JIS R 1601 setting a distance between supporting points to 27 mm and a rate of loading to 0.5 mm/min. Table 4 shows the average value of the bending strength of each magnet structure, taken after the measurement was performed 30 times.

Corrosion Resistance

The magnet joined bodies and the like obtained in Examples and Comparative Examples were each machined in a size of 40 mm in length×10 mm in width. Each magnet structure after being machined was left to stand for 200 hours in a saturated water vapor atmosphere at 120° C., 2 atom, and a relative humidity of 100% to measure the amount of mass reduced due to corrosion. Table 4 shows the results of evaluating the measured values according to the following criteria.

A: The amount of mass reduced is less than 1.0 mg/cm$^2$.

B: The amount of mass reduced is 1.0 mg/cm$^2$ or more and less than 2.0 mg/cm$^2$.

C: The amount of mass reduced is 2.0 mg/cm$^2$ or more and less than 5.0 mg/cm$^2$.

D: The amount of mass reduced is 5.0 mg/cm$^2$ or more and less than 15.0 mg/cm$^2$.

E: The amount of mass reduced is 15.0 mg/cm$^2$ or more.

Magnetic Properties

The magnetic properties of the magnet joined bodies and the like obtained in Examples and Comparative Examples were measured using a B—H tracer. As the magnetic properties, the residual magnetic flux density Br and the coercivity HcJ were measured. Table 4 shows the measurement results.

TABLE 3

| | Content of diffusion material $R_H$ (% by mass) | $R_L$ oxide phase | $R_L$—Co—Cu phase | $R_L$ rich phase | Thickness of intermediate layer (μm) | Coverage (%) |
|---|---|---|---|---|---|---|
| Example 1 | 0.6 | Exists | Exists | Exists | 31 | 96 |
| Example 2 | 0.6 | Exists | Exists | Exists | 28 | 91 |
| Example 3 | 0.6 | Exists | Exists | Exists | 29 | 89 |
| Example 4 | 0.6 | Exists | Exists | Exists | 29 | 93 |
| Example 5 | 0.6 | Exists | Exists | Exists | 29 | 98 |
| Example 6 | 0.6 | Exists | Exists | Exists | 30 | 94 |
| Example 7 | 0.6 | Exists | Exists | Exists | 31 | 100 |
| Comparative Example 1 | 0.6 | Exists | Exists | Exists | 16 (Surface) | 71 |
| Comparative Example 2 | 0.6 | Exists | Exists | Exists | 15 (Surface) | 68 |
| Comparative Example 3 | 0.6 | Not exist | Exists | Exists | 20 | 45 |
| Comparative Example 4 | 0.6 | Not exist | Exists | Exists | 18 | 43 |
| Comparative Example 5 | 0.6 | Not exist | Exists | Exists | 21 | 47 |
| Comparative Example 6 | 0.6 | Exists | Not exist | Exists | 33 | 88 |

TABLE 4

| | Bending strength (MPa) | Corrosion resistance | Residual magnetic flux density Br (mT) | Coercivity HcJ (KA/m) |
|---|---|---|---|---|
| Example 1 | 453 | A | 1425 | 1953 |
| Example 2 | 424 | A | 1421 | 1946 |
| Example 3 | 383 | B | 1418 | 1946 |
| Example 4 | 438 | A | 1423 | 1950 |
| Example 5 | 432 | A | 1427 | 1948 |
| Example 6 | 462 | A | 1420 | 1957 |
| Example 7 | 476 | A | 1431 | 1961 |
| Comparative Example 1 | 383 | B | 1429 | 1838 |
| Comparative Example 2 | 364 | C | 1423 | 1843 |
| Comparative Example 3 | 380 | D | 1423 | 1945 |
| Comparative Example 4 | 354 | E | 1420 | 1944 |
| Comparative Example 5 | 413 | C | 1429 | 1949 |
| Comparative Example 6 | 380 | C | 1425 | 1820 |

Figure 5:
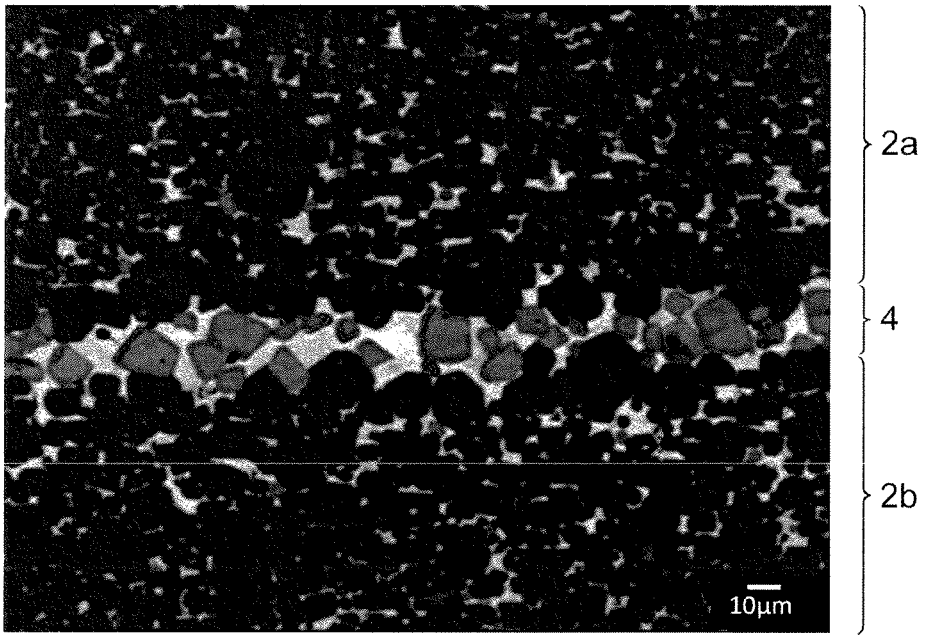
FIG. 5 is an SEM image at 500 magnifications, showing a joining portion in a cross section of a magnet structure obtained in Example 1.
Figure 6:
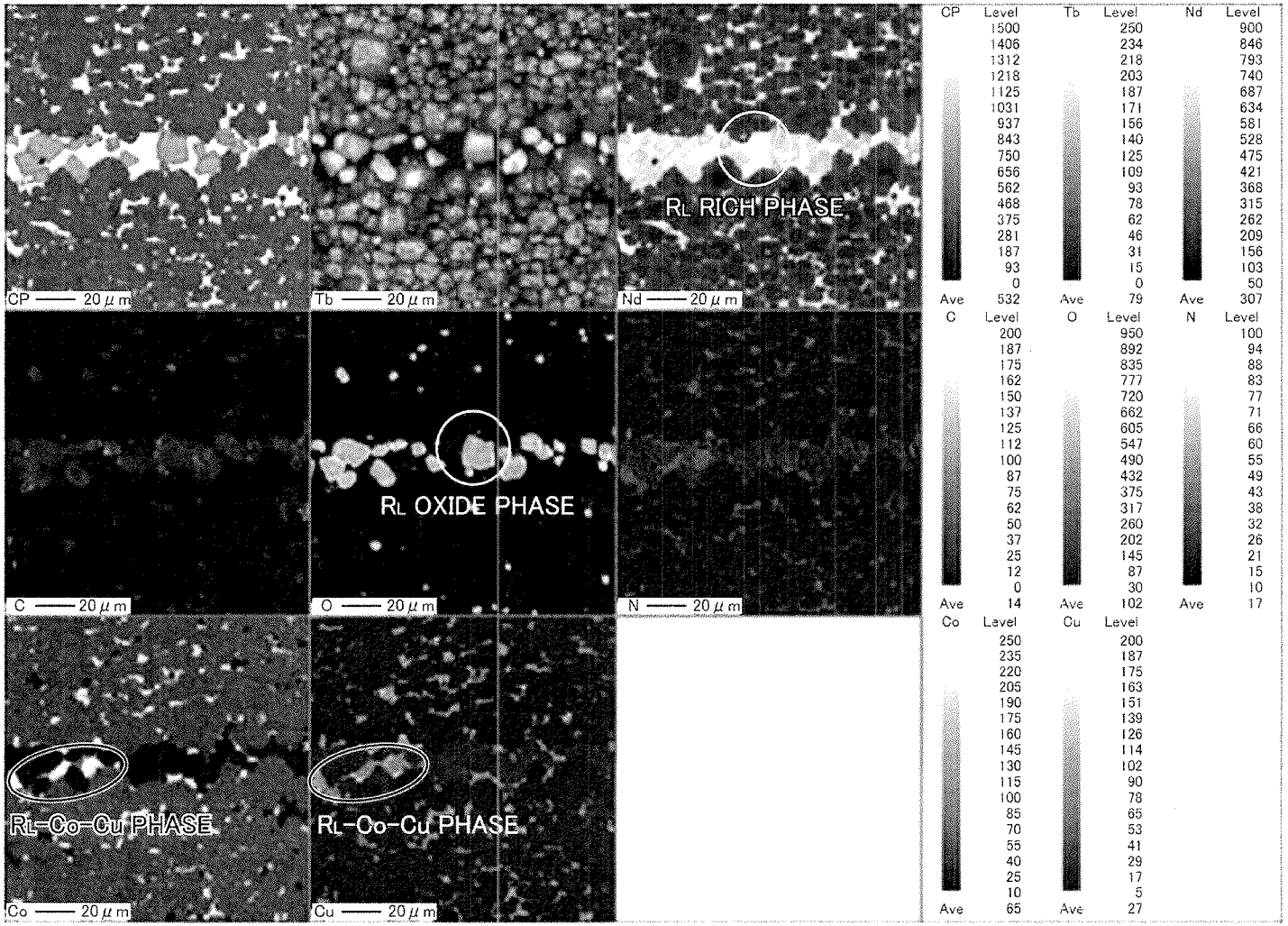
FIG. 6 shows results of analyzing a distribution of each constituent element for the joining portion shown in FIG. 5 with EPMA in a mapping format.

FIG. 5 is an SEM image at 500 magnifications, showing a joining portion in a cross section of the magnet structure obtained in Example 1. The image shown in FIG. 5 shows the first magnet 2*a* and the second magnet 2*b* mainly consisting of dark gray color, and the intermediate layer 4 being positioned between the first magnet 2*a* and the second magnet 2*b* and mainly consisting of white color. FIG. 6 shows the results of analyzing a distribution of each constituent element for the joining portion shown in FIG. 5 with EPMA in a mapping format. The image at the upper left in FIG. 6 is the SEM image, and in an image other than the image at the upper left, the content of each element in the cross section shown in the SEM image is expressed by the shades of color. The portion expressed in white indicates a portion where the content of an element is high, and the portion expressed in black indicates a portion where the content of an element is low. In the magnet structure obtained in Example 1, the intermediate layer comprises an $R_L$ rich phase, an $R_L$ oxide phase, and an $R_L$—Co—Cu phase. The existence of the $R_L$ oxide phase, the $R_L$—Co—Cu phase, and the $R_L$ rich phase of the magnet structure is checked by the results of analyzing the distribution of the constituent elements in a mapping format shown in FIG. 6. Hereinafter, how to check the state of each element in the respective layers and the existence of the $R_L$ oxide phase, the $R_L$—Co—Cu phase, and the $R_L$ rich phase by the above-described analysis will be described taking the magnet structure obtained in Example 1 as an example.

Figure 7:
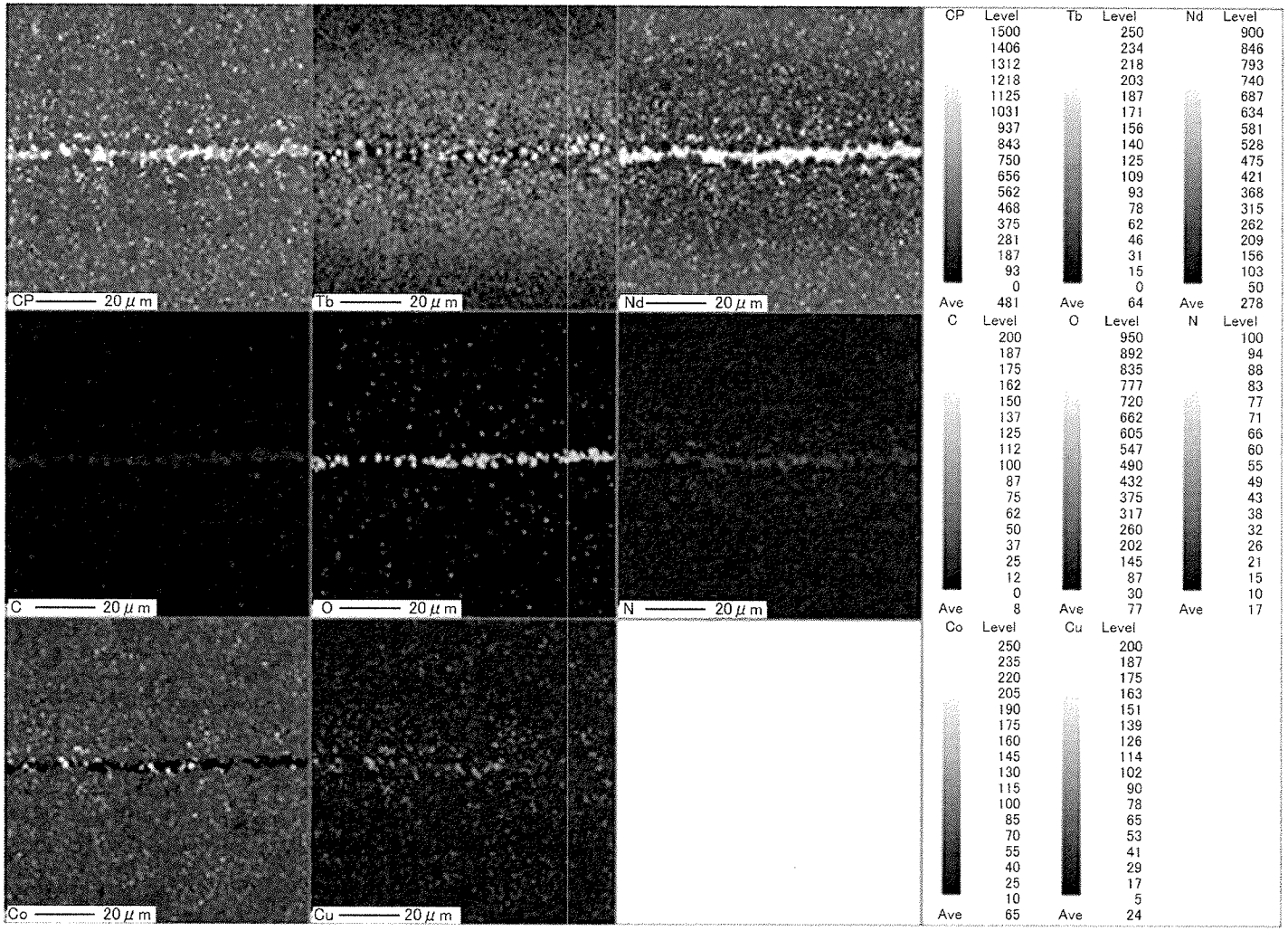
FIG. 7 is an SEM image at 150 magnifications, showing a joining portion in a cross section of a magnet structure obtained in Example 1, the image showing the joining portion which is shown in FIG. 5 and FIG. 6 and which includes a peripheral portion thereof.

In the image at the upper right in FIG. 6, a layered region where a high concentration of Nd exists is shown, and it can be ascertained that the region is mainly composed of Nd (light rare earth element $R_L$). The region corresponds to the intermediate layer in FIG. 5, and the upper region and the lower region of the above-described region correspond to the first magnet and the second magnet respectively. Accordingly, from the upper right image in FIG. 6, it can be ascertained that the content of the $R_L$ in the intermediate layer is higher than the content of the $R_L$ in the first magnet and in the second magnet. In the image at the upper center in FIG. 6, a region where Tb exists is shown at the position of the intermediate layer, and further, a region where Tb exists is also shown at the position of the first magnet and at the position of the second magnet. From the fact that Nd, which was not contained in the diffusion material paste before the heat treatment of the laminated body, is contained in the intermediate layer after the heat treatment, and that Tb, which was not contained in the magnet (base material) before the heat treatment of the laminated body, is contained in the first magnet and in the second magnet after the heat treatment, it can be said that the first magnet, the second magnet, and the intermediate layer of the magnet structure obtained in Example 1 are layers obtained accompanying the transfer of the elements due to the heat treatment. The transfer of the elements due to the heat treatment can be more clearly understood with reference to FIG. 7. FIG. 7 is an SEM image at 150 magnifications, showing a joining portion in a cross section of the magnet structure obtained in Example 1, the image showing the joining portion which is shown in FIG. 5 and FIG. 6 and which includes a peripheral portion thereof. In the image at the upper center in FIG. 7, a region where Tb is widely distributed in the first magnet and in the second magnet with the position of the intermediate layer being as the center of the distribution is shown. The concentration of Tb is high in a region near the intermediate layer and becomes lower as the distance from the intermediate layer becomes larger. On the other hand, in the image at the upper right in FIG. 7, the concentration of Nd is lowered in the same region as the region where Tb is diffused. From these images, it can also be said that Tb in the diffusion material paste diffused into the magnets as base materials by the heat treatment, and the Nd in the magnets concentrated to the joining face in such way as to be exchanged for Tb. Since Co and Cu, which was not contained in the diffusion material paste, exist in the intermediate layer in a high concentration, it can be ascertained that the same exchange as that of Tb for Nd also occurs between Tb in the diffusion material paste and, Co and Cu in the magnets as base materials. The concentration of Tb in the whole of the first magnet and the second magnet after the diffusion of Tb was 0.6% by mass. The concentration of each element in the first magnet and in the second magnet was almost the same as the concentration of each element in the respective magnets (first base material and the second base material) before the heat treatment, in regions other than the above.

In the image at the middle center in FIG. 6, a region where O exists is shown in the area surrounded by a circle in the intermediate layer. In the intermediate layer, there exist a large number of similar areas where O exists, other than the area surrounded by a circle. Further, in the image at the upper right in the FIG. 6, the existence of Nd in a concentration of 71.4% by mass is shown in the region where O exists in a concentration of 19.8% by mass in the intermediate layer. Accordingly, from the images in FIG. 6, it can be ascertained that the $R_L$ oxide phase exists in the intermediate layer.

On the other hand, in the images at the upper right and middle center in FIG. 6, a region where Nd exists but O does not exist in the intermediate layer is also shown. Among these, in the image at the upper right in FIG. 6, a region where Nd exists in a particularly high concentration, as high as 80.3% by mass, is shown in the area surrounded by a circle in the intermediate layer, and it can be said that the region is the $R_L$ rich phase.

Further, in the images at the lower left and lower center in FIG. 6, a region where Co and Cu exist in a high concentration, as high as 7.2% by mass and 3.5% by mass respectively, and O exists in a low concentration, as low as 3.5% by mass, is shown in the area surrounded by an ellipse in the intermediate layer. This region contains Nd, but the concentration thereof is 72.6% by mass and is lower than that in the $R_L$ rich phase. In addition, the concentrations of Co and of Cu in the intermediate layer are larger than those in the $R_L$ rich phase. The existence of Co and Cu is shown in the first magnet and in the second magnet, but it can be ascertained that the region where Co and Cu exist in the first magnet and in the second magnet are smaller than the region where Co and Cu exist in the intermediate layer, and that the concentrations of Co and of Cu in the first magnet (upper layer) and in the second magnet (lower layer) are lower than the concentrations of Co and of Cu in the intermediate layer respectively. Accordingly, from the images in FIG. 6, it can be ascertained that the $R_L$—Co—Cu phase exists in the intermediate layer. The volume percentages of the $R_L$ oxide phase, of the $R_L$ rich phase, and of the $R_L$—Co—Cu phase in the intermediate layer in the magnet structure of Example 1 were measured and calculated to find that they were 55.5% by volume, 5.0% by volume, and 39.5% by volume respectively.

The same analysis was conducted for the magnet joined bodies and the like obtained in other Examples and Comparative Examples, and the existence of the $R_L$ oxide phase, of the $R_L$—Co—Cu phase, and of the $R_L$ rich phase was ascertained in any of the magnet joined bodies obtained in Examples. In Examples 2 to 7, the concentration of each element in each phase in the intermediate layer was almost the same as in Example 1. In addition, the volume percentage of the $R_L$ rich phase in the intermediate layer was also almost the same as in Example 1. However, the volume percentage of the $R_L$—Co—Cu phase in the intermediate layer was 35.2% by volume in Example 3 and 44.2% by volume in Example 7. The volume percentage of the $R_L$ oxide phase in the intermediate layer was decreased or increased from that in Example 1 by the amount corresponding to the increase or decrease in the volume percentage of the $R_L$—Co—Cu phase. On the other hand, a region corresponding to the intermediate layer does not exist in Comparative Examples 1 and 2, the diffusion of Tb from the diffusion material paste and the transfer of Nd and the like to the surface of the base material were ascertained, but the region of diffusion was smaller than those in Examples. In addition, the diffusion of Tb from the Tb foil was also ascertained in Comparative Examples 3 to 5, but oxygen was not supplied from the Tb foil where the oxygen concentration is about 0.01% by mass, so that Nd, which had transferred to the joining face from the magnet (base material) before the heat treatment, was not converted to an oxide, and exclusively existed as the $R_L$ rich phase in the intermediate layer. Accordingly, in the intermediate layer of the magnet joined bodies obtained in Comparative Examples 3 to 5, the existence of the $R_L$—Co—Cu phase and of the $R_L$ rich phase was ascertained, but the existence of the $R_L$ oxide phase was not ascertained. In addition, in comparative examples 3 to 5, the transfer of Co and Cu in the magnet as the base material to the joining face was relatively small and the deposition of the $R_L$—Co—Cu phase was small probably because oxygen was not supplied from the Tb foil.

From the evaluation results shown in Table 4, it was ascertained that the magnet joined bodies obtained in Examples have more excellent bending strength and corrosion resistance than the magnet joined bodies and the like obtained in Comparative Examples. It is considered that such improvements in the bending strength and the corrosion resistance were achieved because both the $R_L$ oxide phase and the $R_L$—Co—Cu phase existed in the intermediate layer. In addition, from Examples 1 to 3, it can be ascertained that the bending strength and the corrosion resistance of the magnet joined bodies were further improved particularly when the content of Co and of Cu in the magnet as a base material was high. It is considered that by allowing the content of Co and of Cu in the magnet as a base material to be high, the amount of the $R_L$—Co—Cu phase deposited in the intermediate layer is increased, and further, the thickness and the coverage of the intermediate layer can be improved, thereby enabling further improvements in the bending strength and the corrosion resistance of the magnet joined bodies.

On the other hand, as described above, in Comparative Examples 1 and 2, the region where Tb diffuses exists only on one side, and according to this, the amount of Nd, Co, and Cu that transfer decreased, so that sufficient deposition of the $R_L$ oxide phase and the $R_L$—Co—Cu phase, thickness of the surface covering layer, and coverage were not obtained. Therefore, in Comparative Examples 1 and 2, excellent bending strength and corrosion resistance were not obtained, and the coercivity HcJ was low.

In addition, in Comparative Examples 3 to 5, the $R_L$ oxide phase was not formed in the intermediate layer. It is considered that the bending strength and the corrosion resistance of the magnet structure were lowered because in the intermediate layer, the $R_L$ oxide phase did not exist, the amount of the $R_L$ rich phase was large, and the amount of the $R_L$—Co—Cu phase deposited was small. In Comparative Example 4 where the content of Co and of Cu in the base material was low among Comparative Examples 3 to 5, the bending strength and the corrosion resistance were remarkably lowered.

In Comparative Example 6, since silicone grease was used as a diffusion material paste, the amount of oxygen supplied became large, and the R, Co, and Cu each exist as an oxide phase, so that the $R_L$—Co—Cu phase as a metal phase did not exist. The content of Co and of O in the Co oxide phase was 75% by mass and 25% by mass respectively. In addition, the content of Cu and of O in the Cu oxide phase was 85% by mass and 15% by mass respectively. Therefore, the bending strength and the corrosion resistance in the magnet structure obtained in Comparative Example 6 were lower than those in the magnet structure of Example 1.

REFERENCE SIGNS LIST

2*a*, 2*b*, 2*c* . . . Magnet, 4, 4*a*, 4*b* . . . Intermediate layer, 10 . . . Magnet structure, 12*a*, 12*b* . . . Magnet (base material), 14 . . . Coating film (diffusion material paste)

What is claimed is:

1. A magnet structure comprising:

a first magnet;

a second magnet; and an intermediate layer joining the first magnet and the second magnet; wherein each of the first magnet and the second magnet is a permanent magnet comprising: a rare earth element R; a transition metal element T; and boron B, the rare earth element R comprises: a light rare earth element $R_L$ comprising at least Nd; and a heavy rare earth element $R_H$, the transition metal element T comprises Fe, Co, and Cu, and the intermediate layer comprises:

an $R_L$ oxide phase comprising an oxide of the light rare earth element $R_L$; and an $R_L$—Co—Cu phase comprising the light rare earth element $R_L$, Co, and Cu, a volume percentage of the $R_L$—Co—Cu phase being 30 to 80% by volume, wherein each of the first magnet and the second magnet has a region where a concentration of the heavy rare earth element in the magnet becomes lower as a distance from the intermediate layer becomes larger.

2. The magnet structure according to claim 1, wherein the intermediate layer further comprises an $R_L$ rich phase.

3. The magnet structure according to claim 1, wherein concentrations of the $R_L$, of Co, and of Cu in the $R_L$—Co—Cu phase are higher than concentrations of the $R_L$, of Co, and of Cu respectively in the magnet.

4. The magnet structure according to claim 1, wherein a content of the $R_L$ in the intermediate layer is higher than a content of the $R_L$ in the first magnet and in the second magnet.

5. The magnet structure according to claim 1, further comprising:

a third magnet; and another intermediate layer joining the second magnet and the third magnet.

6. The magnet structure according to claim 1, wherein the contents of Cu in the first and second magnets are 0.17 mass % or more.

* * * * *